US009615622B2

(12) United States Patent
Cook

(10) Patent No.: US 9,615,622 B2
(45) Date of Patent: Apr. 11, 2017

(54) FOOTWEAR WITH RIMMED SOLE STRUCTURE

(71) Applicant: NIKE, Inc., Beaverton, OR (US)

(72) Inventor: Christopher S. Cook, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 69 days.

(21) Appl. No.: 14/843,901

(22) Filed: Sep. 2, 2015

(65) Prior Publication Data

US 2017/0055627 A1 Mar. 2, 2017

(51) Int. Cl.

| | |
|---|---|
| ***A43B 5/06*** | (2006.01) |
| ***A43C 15/16*** | (2006.01) |
| ***A43B 13/22*** | (2006.01) |
| ***A43C 11/14*** | (2006.01) |

(52) U.S. Cl.

CPC ..... *A43B 5/06* (2013.01); *A43B 13/223* (2013.01); *A43B 13/226* (2013.01); *A43C 11/14* (2013.01); *A43C 11/1493* (2013.01); *A43C 15/161* (2013.01)

(58) Field of Classification Search

CPC ..... A43B 5/06; A43B 13/26; A43B 13/223; A43B 13/226; A43C 11/1493

See application file for complete search history.

(56) References Cited

U.S. PATENT DOCUMENTS

| | | | | |
|---|---|---|---|---|
| 4,335,530 | A * | 6/1982 | Stubblefield | A43B 5/00 36/30 R |
| 4,676,010 | A * | 6/1987 | Cheskin | A43B 13/12 36/114 |
| 4,885,851 | A * | 12/1989 | Peterson | A43B 3/0094 36/127 |
| 5,185,943 | A * | 2/1993 | Tong | A43B 13/184 36/27 |
| D356,672 | S * | 3/1995 | Ueda | D2/959 |
| 8,302,329 | B2 * | 11/2012 | Hurd | A43B 7/20 36/68 |
| 9,445,645 | B2 * | 9/2016 | Auger | A43B 1/0009 |
| 2006/0137221 | A1 * | 6/2006 | Dojan | A43B 13/20 36/29 |
| 2009/0100716 | A1 * | 4/2009 | Gerber | A43B 5/02 36/114 |
| 2010/0199523 | A1 * | 8/2010 | Mayden | A43B 7/144 36/103 |
| 2013/0160328 | A1 * | 6/2013 | Hatfield | A43B 23/02 36/103 |
| 2014/0202042 | A1 | 7/2014 | Berend et al. | |
| 2014/0215729 | A1 | 8/2014 | Curl et al. | |
| 2014/0215857 | A1 | 8/2014 | Curl et al. | |
| 2014/0215862 | A1 | 8/2014 | Curl et al. | |
| 2015/0082669 | A1 * | 3/2015 | Peikert | A43B 7/125 36/30 R |
| 2016/0374426 | A1 * | 12/2016 | Auger | A43B 13/141 36/30 R |

* cited by examiner

*Primary Examiner* — Ted Kavanaugh
(74) *Attorney, Agent, or Firm* — Banner & Witcoff, Ltd.

(57) ABSTRACT

A high jumping shoe may include a sole structure that includes a base plate and a rim attached to the base plate on a lower surface. Portions of the rim may extend into and fill openings in the base plate. Traction element receptacles may be embedded in those rim portions. The rim and base plate may be formed different materials. The shoe may further include one or more reinforcing straps on a medial side.

20 Claims, 10 Drawing Sheets

FOOTWEAR WITH RIMMED SOLE STRUCTURE

BACKGROUND

Conventional articles of footwear generally include an upper and a sole structure. The upper provides a covering for the foot and securely positions the foot relative to the sole structure. The sole structure is secured to a lower portion of the upper and is configured so as to be positioned between the foot and the ground when a wearer is standing, walking, or running. In many sports, an outsole may include elements to increase traction and reduce the chance of a shoe slipping relative to a ground surface. Shoes designed for many track events, for example, may include removable spikes that fit within receptacles located on an outsole.

Some sports may require types of foot movements that are uncommon in other sports. Participants in a particular sport may benefit from footwear that is configured to accommodate the types of movements common to that sport and to provide support for a wearer's foot during such movements. High jumping is a sport that involves a unique combination of body movements. For example, many high jumpers use a technique commonly known as the "Fosbury Flop." Using this technique, an athlete approaches the high jump bar by running along a J-shaped path. At the curved portion of the path, the jumper's body rotates and the jumper pivots and pushes off the outside foot (i.e., the foot closer to the center of J-shaped path). As the jumper turns and lifts off, the jumper's back faces the bar as the jumper performs the actual jump. This unique maneuver results in combinations of foot motions different from those of many other sports.

BRIEF DESCRIPTION OF THE DRAWINGS

Some embodiments are illustrated by way of example, and not by way of limitation, in the figures of the accompanying drawings and in which like reference numerals refer to similar elements.

DETAILED DESCRIPTION

Figure 1:
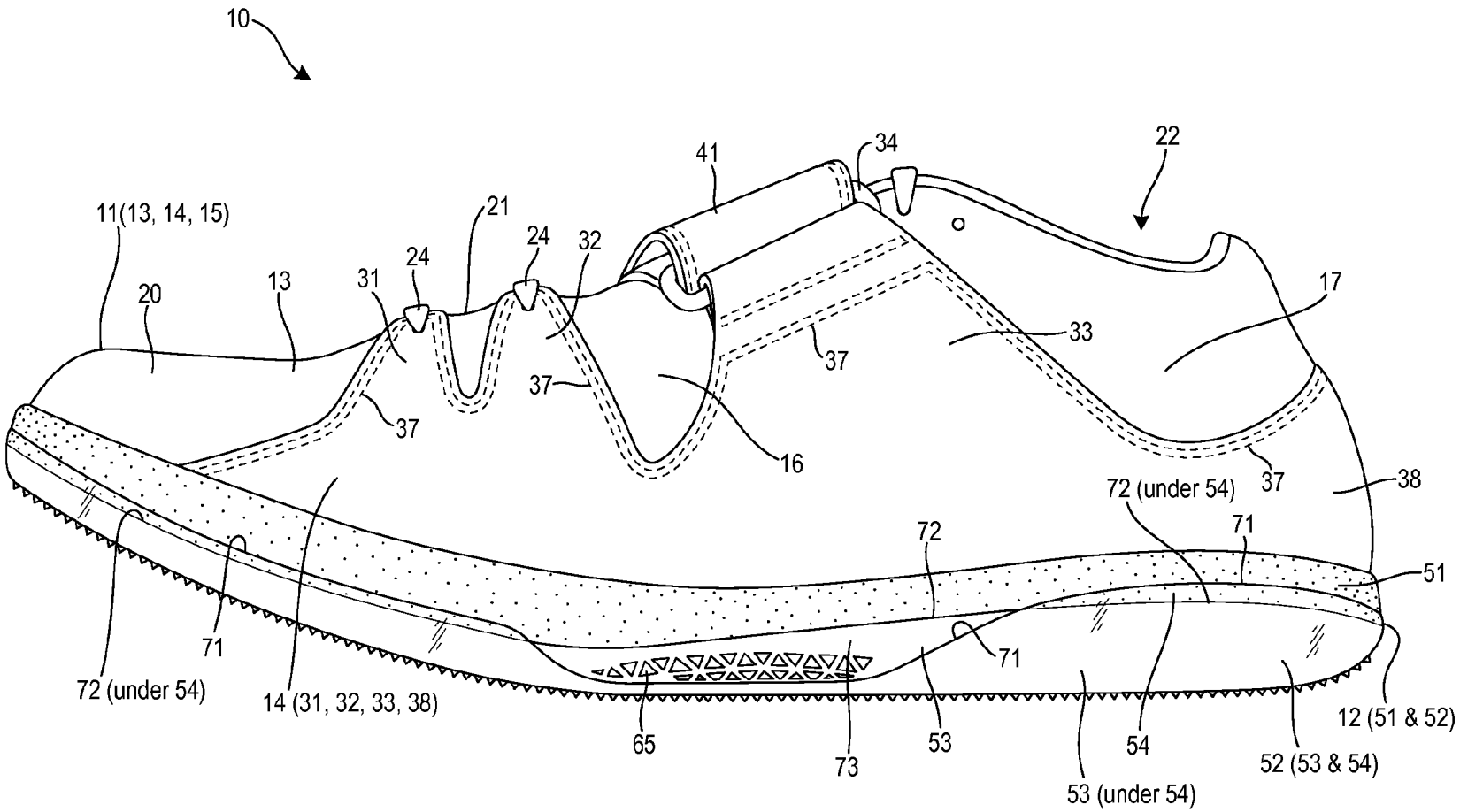
FIG. 1 is a medial side view of a shoe according to some embodiments.

As with many types of track and field events, shoes worn by a high jumper may advantageously include traction elements such as track spikes. So that such elements can be replaced when worn or when an athlete wishes to change to a longer or shorter element (e.g., because of different track surfaces), it is desirable for a shoe sole structure to include receptacles that permit installation and subsequent non-destructive removal of a traction element. For many track events, it is also desirable for a shoe to be lightweight while at the same time having a relatively springy feel.

Moreover, and as previously described, the sport of high jumping may involve maneuvers that result in unique combinations of foot movements. These foot movements may impose forces on a foot that are different in character from the forces imposed during other track and field events. As a jumper performs the actual jump, for example, the jumper turns and pushes off the ground using his or her outside foot. This results in a combination of pivoting and pronation and imposes substantial forces against a medial side of the shoe worn on the outside foot. If that shoe does not provide sufficient support, the jumper's foot may shift relative to the shoe sole structure. Such shifting may adversely affect the jumper's performance.

A high jumping shoe according to certain embodiments may include features to address one or more of the above issues, and/or that may otherwise provide advantages. In some such embodiments, a sole structure may include a base plate. A rim may be attached to the base plate on a lower surface. Portions of the rim may extend into and fill openings in the base plate. Traction element receptacles may be embedded in those rim portions. The base plate and the rim may be formed from different materials.

In at least some embodiments, a high jumping shoe may alternatively or additionally include one or more straps to provide support to a medial side of a wearer's foot during the push-off portion of a high jump. In some such embodiments, a restraint strap may be located in a medial midfoot region. In other embodiments, a restraint strap may also or alternatively be located in a medial forefoot region.

To assist and clarify subsequent description of various embodiments, various terms are defined herein. Unless context indicates otherwise, the following definitions apply throughout this specification (including the claims). "Shoe" and "article of footwear" are used interchangeably to refer to an article intended for wear on a human foot. A shoe may or may not enclose the entire foot of a wearer. For example, a shoe upper may include openings that expose portions of a wearer's foot. The "interior" of a shoe refers to space that is occupied by a wearer's foot when the shoe is worn. An interior side, surface, face, or other aspect of a shoe component refers to a side, surface, face or other aspect of that component that is (or will be) oriented toward the shoe interior in a completed shoe. An exterior side, surface, face or other aspect of a component refers to a side, surface, face or other aspect of that component that is (or will be) oriented away from the shoe interior in the completed shoe. In some cases, the interior side, surface, face or other aspect of a component may have other elements between that interior side, surface, face or other aspect and the interior in the completed shoe. Similarly, an exterior side, surface, face or other aspect of a component may have other elements between that exterior side, surface, face or other aspect and the space external to the completed shoe.

Shoe elements can be described based on regions and/or anatomical structures of a human foot wearing that shoe, and by assuming that the interior of the shoe generally conforms to and is otherwise properly sized for the wearing foot. A forefoot region of a foot includes the phalanges, as well as the heads and bodies of the metatarsals. A forefoot element of a shoe is an element having one or more portions located under, over, to the lateral and/or medial side of, and/or in front of a wearer's forefoot (or portion thereof) when the shoe is worn. A midfoot region of a foot includes the cuboid, navicular, and cuneiforms, as well as the bases of the metatarsals. A midfoot element of a shoe is an element having one or more portions located under, over, and/or to the lateral and/or medial side of a wearer's midfoot (or portion thereof) when the shoe is worn. A heel region of a foot includes the talus and the calcaneus. A heel element of a shoe is an element having one or more portions located under, to the lateral and/or medial side of, and/or behind a wearer's heel (or portion thereof) when the shoe is worn. The forefoot region may overlap with the midfoot region, as may the midfoot and heel regions.

Unless indicated otherwise, a longitudinal axis refers to a horizontal heel-toe axis along the center of the foot that is roughly parallel to a line along the second metatarsal and second phalanges. A transverse axis refers to a horizontal axis across the foot that is generally perpendicular to a longitudinal axis. A longitudinal direction is generally parallel to a longitudinal axis. A transverse direction is generally parallel to a transverse axis. "Top," "bottom," and other terms indicating a vertical direction generally assume that surfaces of a sole structure intended for ground contact are resting on a horizontal surface, and that the sole structure is not deformed.

Figure 2:
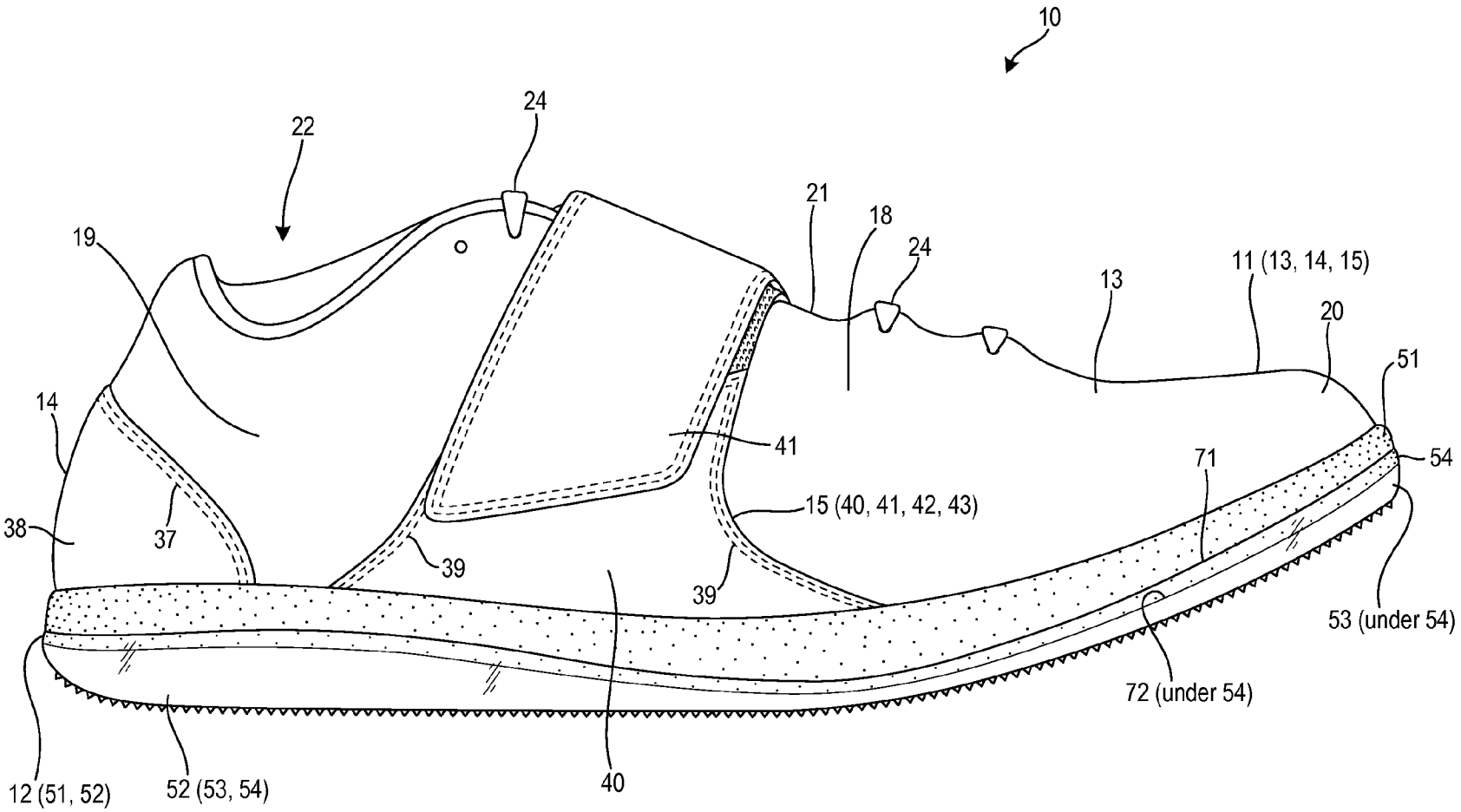
FIG. 2 is a lateral side view of the shoe in FIG. 1.

FIG. 1 is a medial side view of a shoe 10 according to some embodiments. FIG. 2 is a lateral side view of shoe 10. Shoe 10 is configured for wear on a right foot and is part of a pair that includes a shoe (not shown) that is a mirror image of shoe 10 and is configured for wear on a left foot.

Shoe 10 includes an upper 11 coupled to a sole structure 12. Upper 11 and sole structure 12 are merely exemplary. There are innumerable additional embodiments in which an upper may be functionally similar to upper 11, but which may have a visual appearance different from that of upper 11. Similarly, there are innumerable additional embodiments in which a sole structure may be functionally similar to sole structure 12, but which may have a visual appearance different from that of sole structure 12.

Upper 11 includes a shell 13, an overlay 14, and a lateral/instep midfoot strap 15. As explained in further detail below, overlay 14 includes medial forefoot restraint straps 31 and 32, a medial midfoot restraint strap 33, and a heel counter 38. To avoid confusion, reference numbers for some elements in the drawings may include parentheticals to indicate sub-elements. For example, reference number 14 in FIG. 1 includes a parenthetical "(31, 32, 33, 38)" to indicate that restraint straps 31, 32, and 33 and counter 38 are sub-elements of overlay 14.

Shell 13 may be formed from any of various types or materials and have any of a variety of different constructions. Shell 13 includes a medial vamp portion 16, a medial quarter portion 17, a lateral vamp portion 18, a lateral quarter portion 19, and a toe portion 20. Medial vamp portion 16 extends over medial forefoot and medial midfoot side regions to a medial side edge of a tongue opening 21 in an instep region. Medial quarter portion 17 extends over medial midfoot and heel regions to a medial edge of an ankle opening 22. Lateral vamp portion 18 extends over lateral forefoot and lateral midfoot side regions to a lateral side edge of tongue opening 21 in the instep region. Lateral quarter portion 19 extends over lateral midfoot and heel regions to a lateral edge of ankle opening 22. Toe portion 20 extends forward from vamp portions 16 and 18 over a toe region. A lace 24 passes through eyelets on either side of tongue opening 21 and may be tightened and tied in a conventional manner to draw together vamp portions 16 and 18 and snugly secure upper 11 to a wearer foot.

Shell 13 is enclosed to form a foot-receiving interior void of shoe 10, with the bottom of that void providing a footbed having an outline approximately corresponding to the shape of a wearer foot. An insole, sock liner, and/or other element may be included in some or all of the footbed. In the embodiment of shoe 10, a strobel (not shown) or other lasting element is stitched or otherwise secured to a bottom edge of shell 13 to form the footbed and to enclose the foot-receiving interior void. In other embodiments, a shell may include flaps or other portions that fold under and are joined to form a footbed and enclose a foot-receiving interior void. In still other embodiments, lower edges of a shell may be directly bonded to a midsole and/or other component(s) of a sole structure, with a top surface of that midsole (and/or other components) forming the footbed and enclosing the foot-receiving interior void.

Overlay 14 includes medial forefoot restraint straps 31 and 32 and medial midfoot restraint strap 33. Top ends of forefoot restraint straps 31 and 32 include eyes on the medial side of tongue opening 21 and through which lace 24 is threaded. A top end of midfoot restraint strap 33 is formed into a loop that holds a ring 34. A free portion 41 of lateral/instep midfoot strap 15 may be passed through ring 34 and secured, as described in more detail below.

In some embodiments, overlay 14 is formed from continuous single piece of artificial leather and secured to medial vamp portion 16, medial quarter portion 17, and lateral quarter portion 19 of shell 13 by stitching 37 around a periphery of overlay 14. An interior face of overlay 14 may also or alternatively be glued or otherwise bonded to a portion of an exterior face of shell 13. A rear portion of overlay 14 extends around the rear of shell 13 and forms a heel counter 38. A bottom edge of overlay 14 extends to and coincides with a portion of a bottom edge of shell 13 and may be secured, with that portion of the shell 13 bottom edge, to a strobel or lasting element.

As seen in FIG. 2, lateral/instep midfoot strap 15 is a separate piece relative to overlay 14. A bottom part 40 of strap 15 is attached to shell 13, in a midfoot region of lateral vamp portion 18 and in a front region of lateral quarter portion 19, by stitching 39. An interior face of bottom part 40 may also or alternatively be glued or otherwise bonded to a portion of the exterior face of shell 13. A bottom edge of bottom part 40 coincides with a portion of a bottom edge of shell 13 and is secured, with that portion of the shell 13 bottom edge, to a strobel or lasting element.

Figure 3:
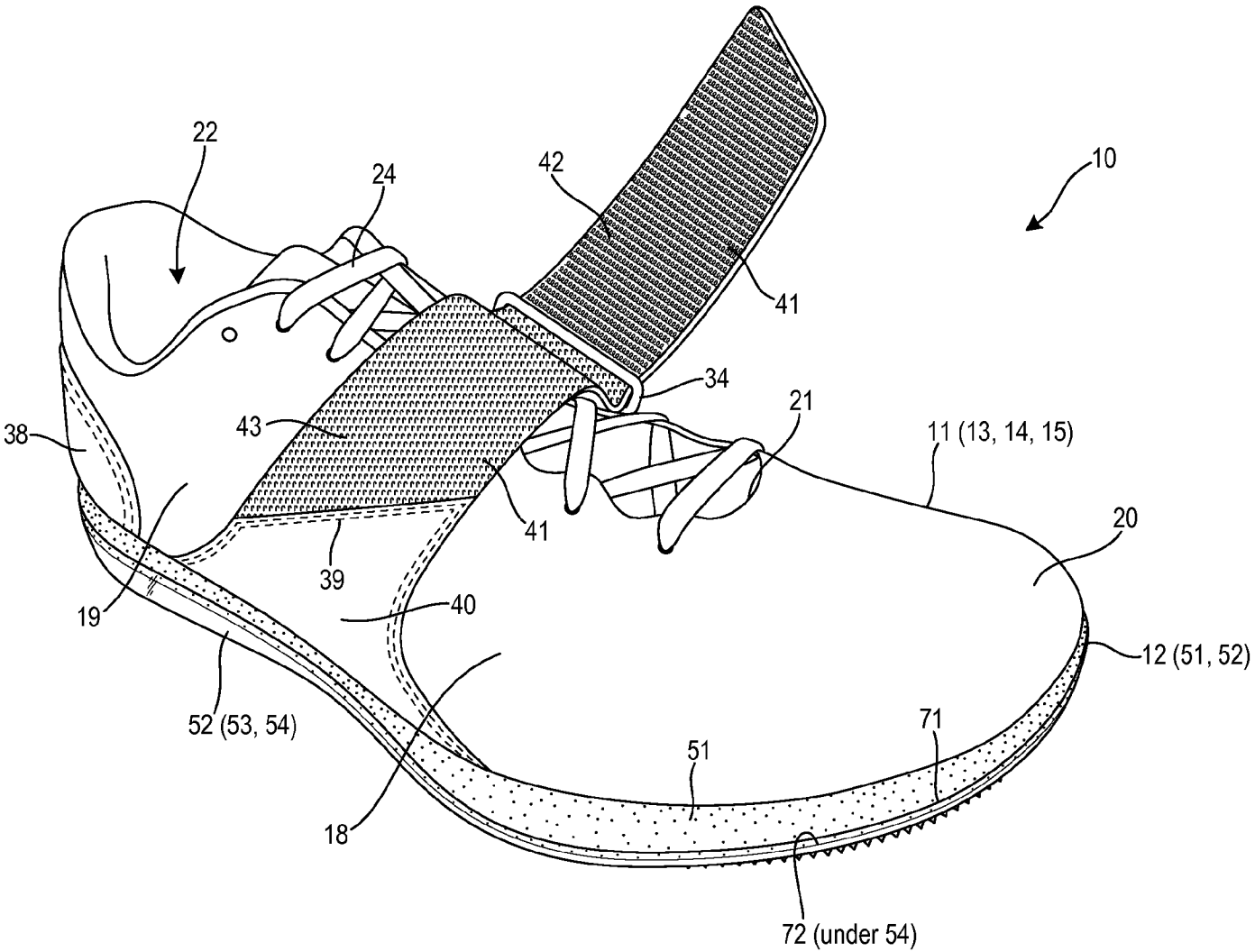
FIG. 3 is a lateral front perspective view of the shoe from FIG. 1 showing a strap in an unsecured condition.

The remainder of strap 15 is not directly attached to shell 13 and forms a free portion 41 that is securable to midfoot restraint strap 33. FIG. 3 is a lateral front perspective view of shoe 10, and shows free end of strap 15 partially unsecured. As seen in FIG. 3, free portion 41 may be extended across tongue opening 21 and lace 24 and inserted into ring 34. Straps 33 and 15 may then be secured to one another by pulling free portion 41 back across tongue opening 21 toward the lateral side of shoe 10, and by pressing loop material 42 on a distal end of free portion 41 against hook material 43 located on a proximal end of free portion 41. Material 42 and material 43 may be complementary pieces of hook and loop fastening material (e.g., VELCRO fastening material).

In the embodiment of shoe 10, forefoot straps 31 and 32 are located in a first phalange and first metatarsal head region and may extend approximately over the distal half of the first metatarsal. In other embodiments, a single medial forefoot strap may replace straps 31 and 32. In still other embodiments, a shoe may include more than two medial forefoot straps. A medial forefoot strap system, whether composed of one or multiple straps, may be positioned to cover medial forefoot regions in addition to or instead of the medial forefoot regions covered by straps 31 and 32.

In the embodiment of shoe 10, medial midfoot strap 33 extends over an arch region. In some embodiments, the location and width of a medial midfoot strap may vary from that shown in FIG. 1.

Forefoot straps need not be part of a single overlay and/or need not be part of an overlay that includes a midfoot strap and a counter. For example, one or more medial forefoot straps could be part of a first overlay element. A medial midfoot strap could be part of a separate second overlay element, and a counter could be part of a separate third overlay element. In some embodiments a single overlay element may include medial forefoot an medial midfoot restraint straps, a counter, and at least a portion of a lateral midfoot strap.

Medial midfoot strap 33 need not have the configuration shown in shoe 10. In some embodiments, for example lateral/instep midfoot strap 15 may be omitted, and a medial midfoot strap may terminate in eyelets at the medial edge of tongue opening in a manner similar to that of forefoot straps 31 and 32. Also or alternatively, a medial forefoot strap could cooperate with a lateral forefoot strap in a manner similar to that shown for straps 33 and 15.

Medial restraint straps 31, 32, and 33 are substantially inelastic and do not noticeably stretch in response to forces imposable by wearer during running and jumping. Medial restraint straps could alternatively be formed from substantially inelastic materials other than synthetic leather. In some embodiments, some or all medial restraint straps are formed from one or more lightweight woven or knitted synthetic materials, and may include reinforcing fibers to further limit stretch.

Sole structure 12 of shoe 10 includes a midsole 51 and an outsole 52. In the drawings, stippling is used to represent midsole 51. As explained in more detail below, outsole 52 includes a base plate 53 and a rim 54, as well as a plurality of receptacles embedded in rim 54. A bottom surface of midsole 51 may be directly bonded to a top surface of base plate 53. A top surface of midsole 51 may be directly bonded to a strobel or other footbed-forming element. In some alternate embodiments, and as indicated previously, an upper may lack a strobel or other lasting element, and bottom edges of the upper may be bonded or otherwise attached to a midsole near an outer edge, with the top surface of the midsole then forming a footbed.

Midsole 51 may be formed from ethylene vinyl acetate (EVA) and/or other polymer foam material. In some embodiments, midsole 51 may be formed from foam materials such as those used in the LUNAR family of footwear products available from NIKE, Inc. of Beaverton, Oreg. Additional examples of foam materials that can be used for midsole 51 include materials described in U.S. Pat. No. 7,941,938, which patent is incorporated by reference herein, TPU (thermoplastic polyurethane) foams, and PU (polyurethane) foams.

In the embodiment of shoe 10, and as discussed below, rim 54 may be formed from a transparent material. In the drawings, certain reference numbers are associated with lead lines pointing to an element visible through that transparent material. To avoid confusion, some such reference numbers may include a clarifying parenthetical. For example, several instances of reference number 53 in FIGS. 1 and 2 include the parenthetical "(under 54)."

Figure 4A:
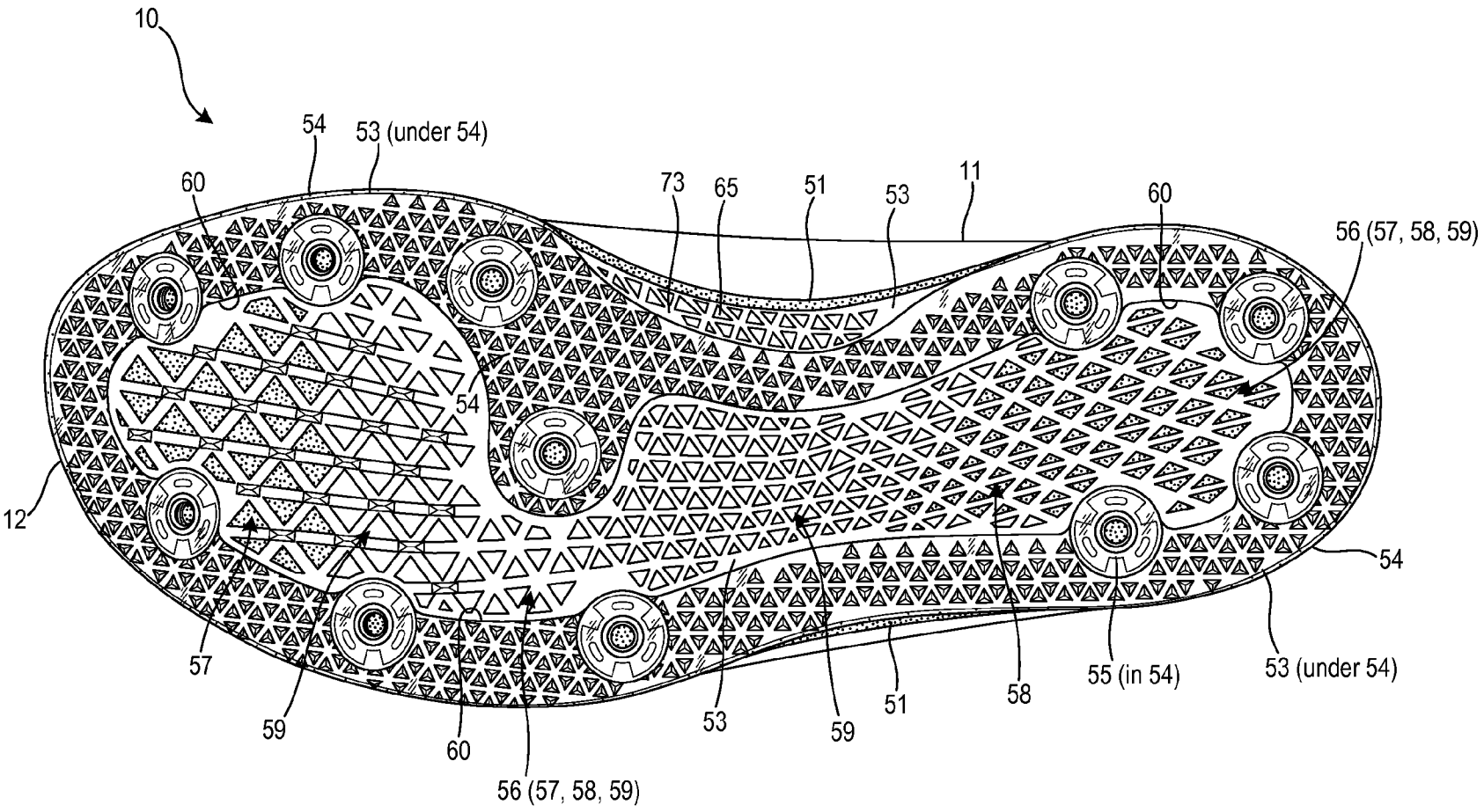
FIG. 4A is a bottom view of the shoe in FIG. 1.

FIG. 4A is a bottom view of shoe 10 and shows the bottom of outsole 52. Base plate 53 extends under the footbed of shoe 10. Rim 54 is attached to a peripheral portion of the bottom surface of base plate 53. A plurality of receptacles 55 are embedded in rim 54, as described in more detail below. Each of receptacles 55 includes a threaded hole into which a threaded post of a track spike may be screwed, and from which the track spike may be non-destructively removed by unscrewing. For convenience, track spikes are omitted from FIGS. 1 through 7.

In at least some embodiments, base plate 53 is formed from a first material and rim 54 is formed from a second material that is different from the first material. In the embodiment of shoe 10, the second material is transparent and reveals flanges and other details of receptacles 55. In some embodiments, the first material may be, e.g., a polyether block amide (PEBA) such as that sold under the trade name PEBAX® 80R53 and the second material may be, e.g., a transparent PEBA such as that sold under the trade name PEBAX® Clear 400.

Rim 54 is bonded to and overlays a peripheral portion of the bottom surface of base plate 53. That peripheral portion includes sub-portions in medial forefoot, lateral forefoot, lateral midfoot, lateral heel, medial heel, and medial midfoot regions. In the embodiment of shoe 10, rim 54 follows a continuous closed path and does not have any gaps. In other embodiments, a rim may include gaps in one or more peripheral sub-portions. In some embodiments, for example, a rim may includes a gap in a medial midfoot peripheral region.

Rim 54 also extends over and covers side edges of base plate 53. This is partially visible in FIG. 4A, but is better seen in FIGS. 1 and 2. As seen in FIGS. 1 and 2, a top edge 71 of rim 54 extends beyond a top edge 72 of base plate 54 around most of sole structure 12. A seen in FIG. 2 and in FIG. 4, however, an exposed side portion 73 of base plate 53 in an arch region is not covered by rim 54.

An inner edge 60 of rim 54 defines an exposed central region 56 of base plate 53. Central region 56 includes open matrix and closed matrix sub-regions. The open and closed matrices can be distinguished based on visibility of portions of a midsole 51 bottom surface in the open matrices.

A forefoot open matrix 57 is defined in the first material of base plate 53 in a forefoot portion of central region 56. A heel open matrix 58 is defined in the first material of base plate 53 in a heel forefoot portion of central region 56. Each of forefoot open matrix 57 and heel open matrix 58 includes a plurality of apertures defined by open ribs, as described below in connection with FIGS. 5-7. A closed matrix 59 is defined in the first material of base plate 53 in a portion of central region 56 between forefoot open matrix 57 and heel open matrix 58. As also explained below, closed matrix 59 includes a plurality of cavities defined by ribs.

Figure 4B:
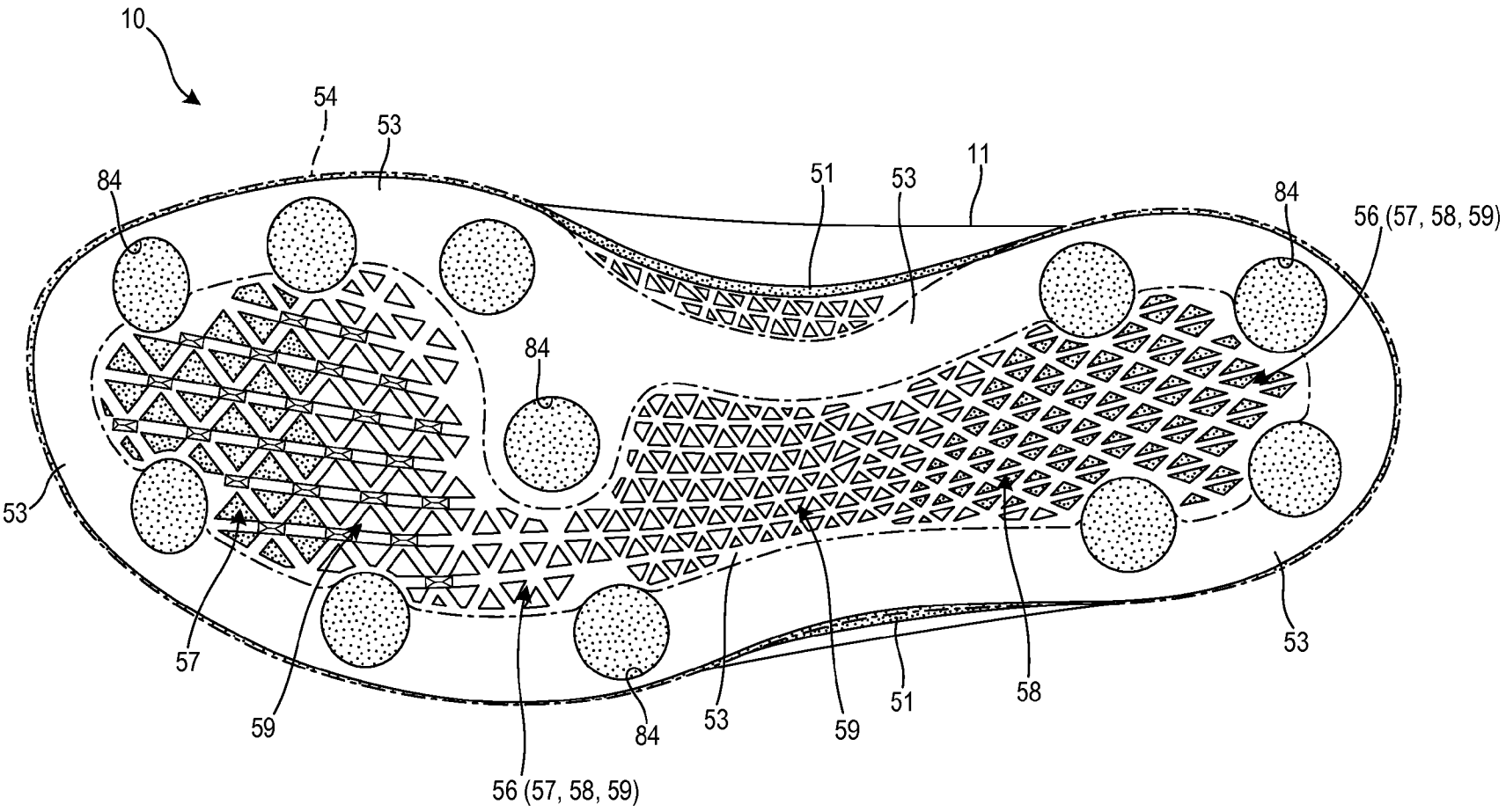
FIG. 4B is a bottom view of the shoe in FIG. 1, but with a rim of the outsole omitted.

FIG. 4B is another bottom view of shoe 10, but with rim 54 and receptacles 55 omitted. An outline of rim 54 is indicated with uneven broken lines. As better seen in FIG. 4B, base plate 53 extends under all of a footbed of shoe 10. As also seen in FIG. 4B, base plate 53 includes a plurality of openings 84. As discussed in further detail below, receptacles 55 are embedded in material of rim 54 that extends into openings 84.

Figure 5:
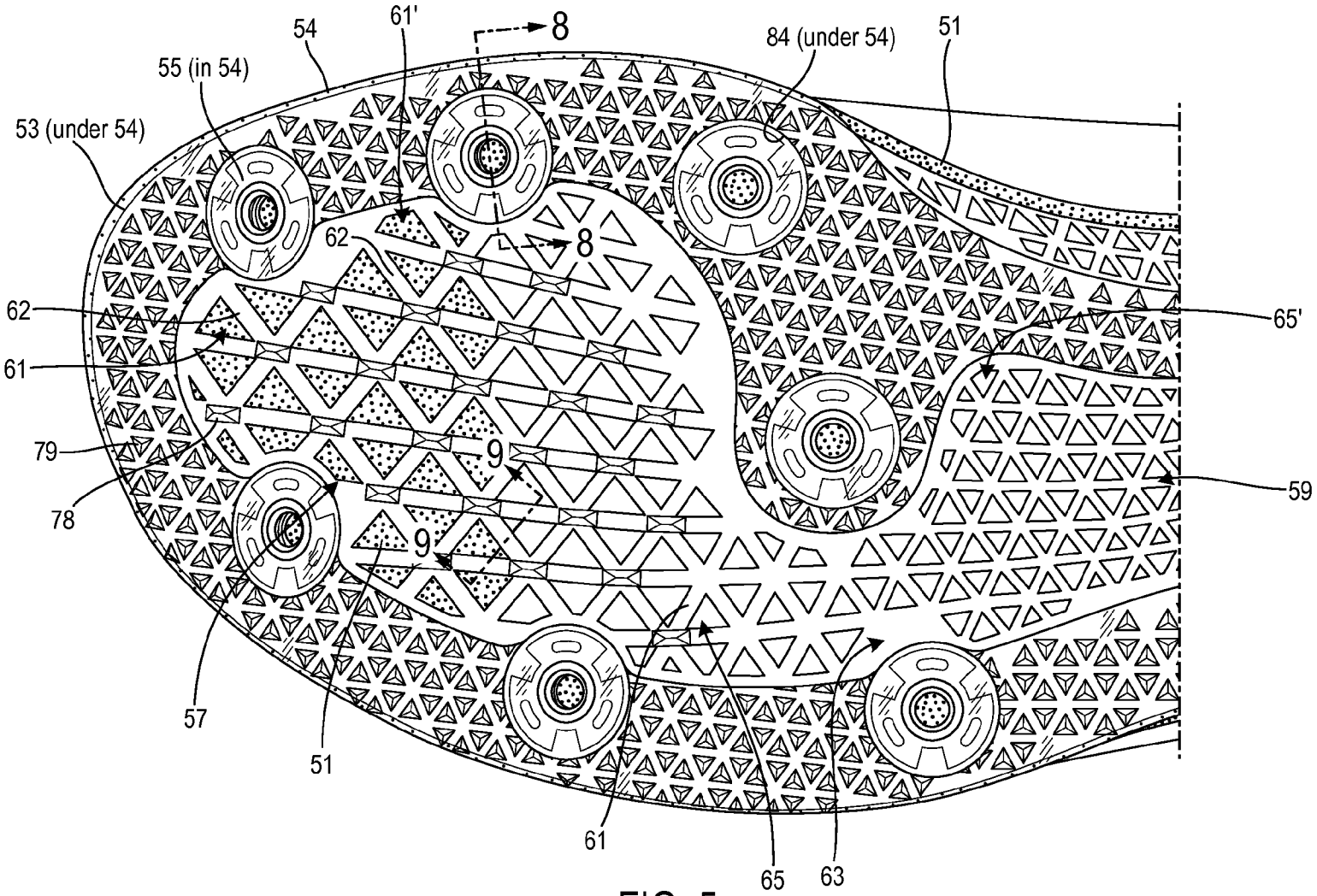
FIG. 5 is an enlarged bottom view of a front portion of the shoe in FIG. 1.

FIG. 5 is an enlarged bottom view of the front of shoe 10 and shows additional details of the forefoot portion of sole structure 12. Forefoot open matrix 57 includes a pattern of apertures 61 that extend completely through base plate 53, i.e., from a bottom surface 63 of base plate 53 to a top surface (not shown) of base plate 53. In the embodiment of shoe 10, portions of a bottom surface of midsole 51 in a forefoot region are exposed by apertures 61. Each of apertures 61 is defined, at least in part, by one or more ribs 62.

At the edges of forefoot open matrix 57, some apertures 61 may be defined in part by material of base plate 53 that is not part of a rib (e.g., aperture 61' is partially defined by a portion of base plate 53 that is not a rib). Ribs 62 in open matrix 57 are interconnected to form a triangular lattice-like configuration, with apertures 61 having triangular or truncated triangular shapes. In the embodiment of shoe 10, forefoot open matrix 57 is located in a phalangeal region that approximately corresponds to the second through fourth toes of a shoe 10 wearer.

Closed matrix 59 begins where forefoot open matrix 57 ends. Closed matrix 59 includes a plurality of cavities 65 formed in bottom surface 63. Each of cavities 65 is defined, at least in part, by one or more ribs 62. At the edges of closed matrix 59, some cavities 65 may be defined in part by material of base plate 53 that is not part of a rib (e.g., cavity 65' is partially defined by a portion of base plate 53 that is not a rib). Ribs 62 in closed matrix 59 are interconnected to form a triangular lattice-like configuration, with cavities 65 having triangular or truncated triangular shapes. Each of cavities 65 includes a floor 67 surrounded by sidewalls 68, with sidewalls 68 being sides of the ribs 62 forming that cavity 65. Cavities 65 may also be formed in side portion 73.

Figure 6:
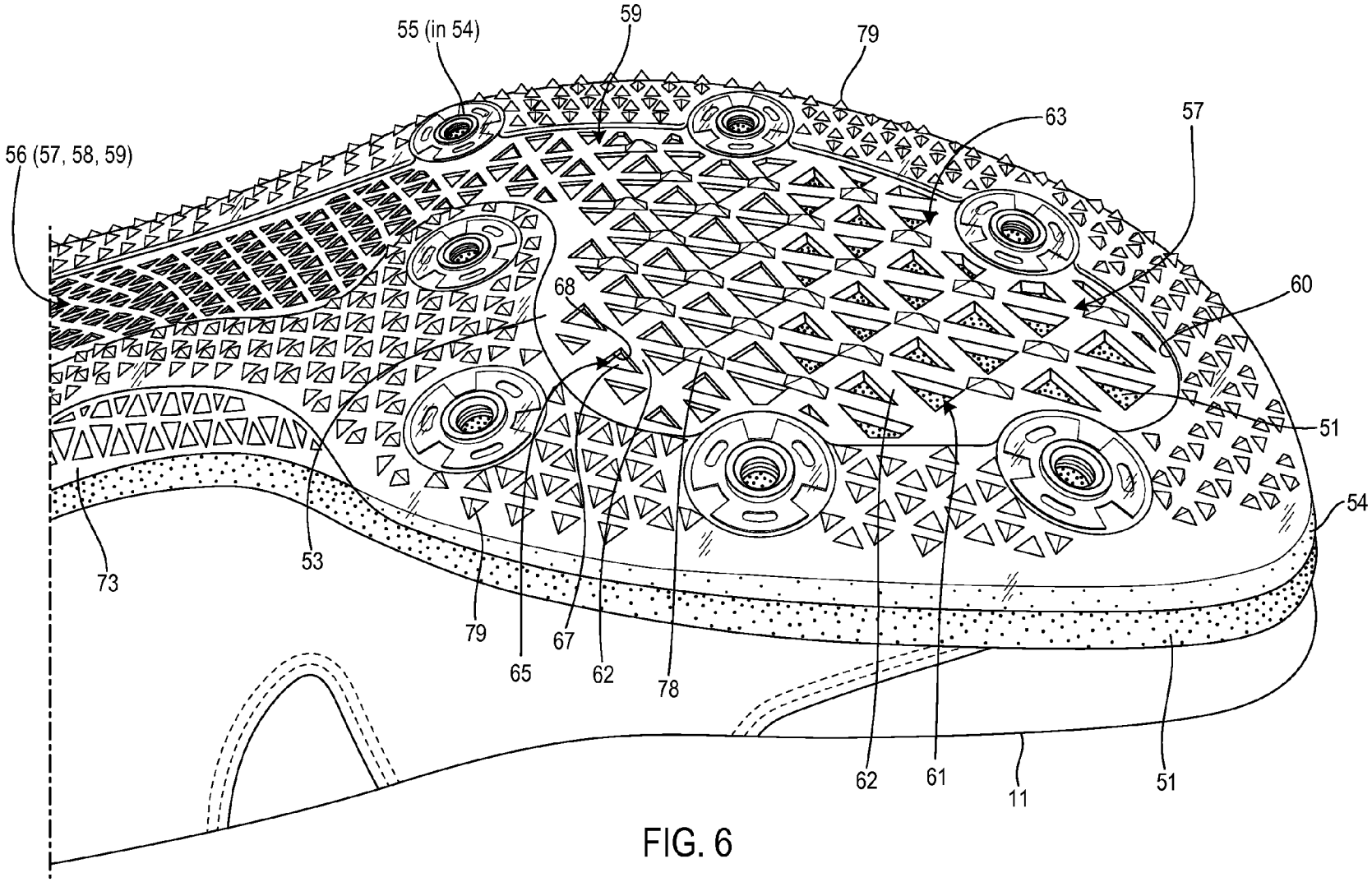
FIG. 6 is an enlarged bottom medial side perspective view of a front portion of the shoe in FIG. 1.

FIG. 6 is an enlarged bottom medial side perspective view of a front portion of shoe 10, and showing additional details of forefoot open matrix 57 and of a front portion of closed matrix 59. As also seen in FIG. 6, the bottom of sole structure 12 includes fixed secondary traction elements 78 formed in base plate 53 and fixed secondary traction elements 79 formed in rim 54. Secondary traction elements 78 are positioned at junctions of ribs 62. Each of secondary traction elements 78 is triangular in shape and may have a height from about 1 millimeter (mm) to approximately 6 mm. Secondary traction elements 79 are formed in the bottom surface of rim 54, are pyramidal in shape, and may have heights from approximately 1 to approximately 3 mm. Although relatively small, secondary traction elements 78 and 79 may provide supplemental traction by contacting small indentations and irregular surface features commonly found in concrete, asphalt, and other paving materials used in track surfaces.

Figure 7:
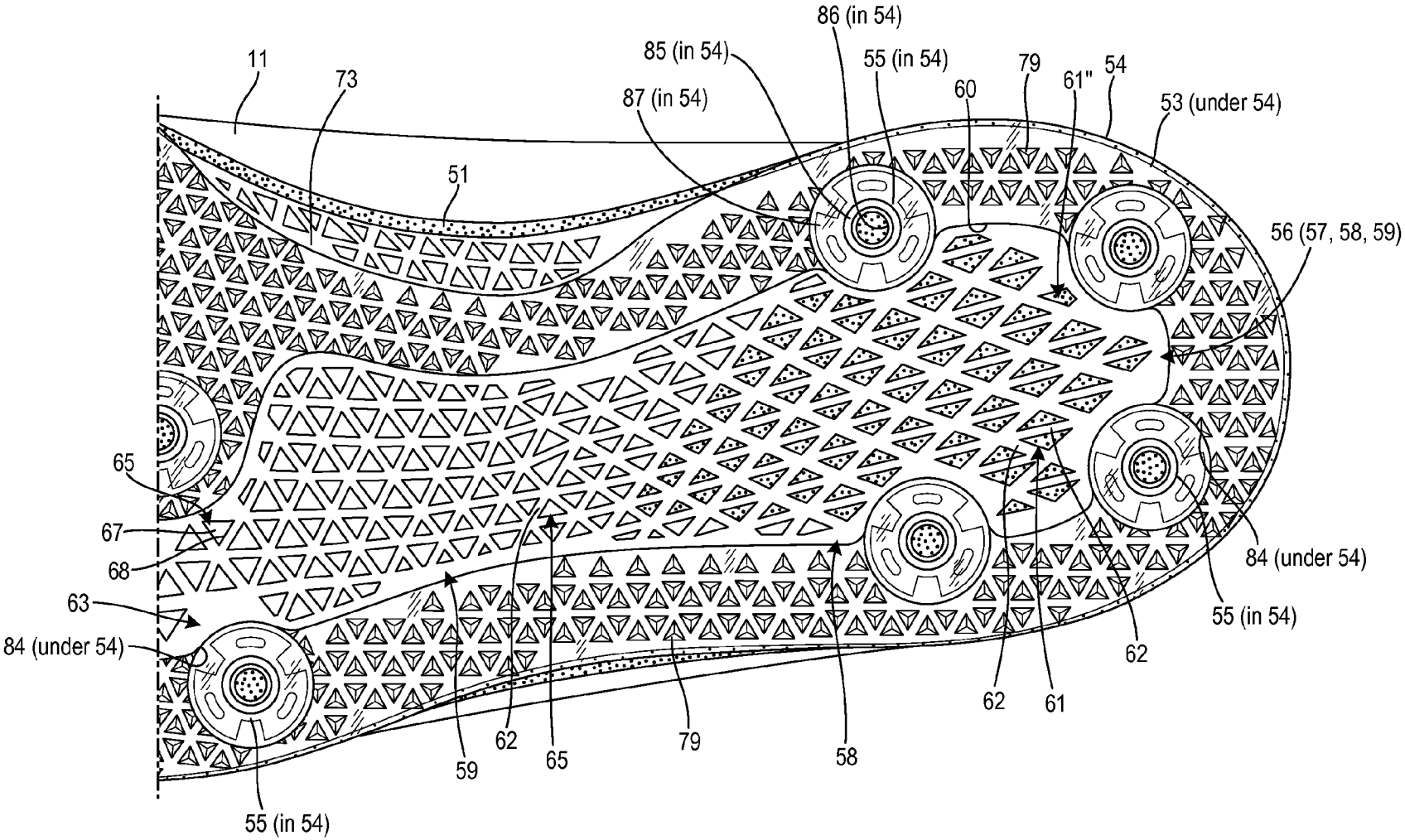
FIG. 7 is an enlarged bottom view of a rear portion of the shoe in FIG. 1.

FIG. 7 is an enlarged bottom view of the rear of shoe 10 and shows additional details of the heel portion of sole structure 12. Heel open matrix 58 includes a pattern of apertures 61 that extend completely through base plate 53, i.e., from bottom surface 63 of base plate 53 to the top surface (not shown) of base plate 53. In the embodiment of shoe 10, portions of a bottom surface of midsole 51 in a heel region are exposed by apertures 61. Each of apertures 61 in the heel open matrix 58 is defined, at least in part, by one or more ribs 62. At the edges of heel open matrix 58, some apertures 61 may be defined in part by material of base plate 53 that is not part of a rib (e.g., aperture 61" is partially defined by a portion of base plate 53 that is not a rib). Ribs 62 in heel open matrix 58 are interconnected to form a triangular lattice-like configuration, with apertures 61 having triangular or truncated triangular shapes. Apertures 61 and ribs 62 in heel open matrix 58 are smaller and more closely packed than apertures 61 and ribs 62 in forefoot open matrix 57.

As further shown in FIG. 7, closed matrix 59 begins where heel open matrix 58 ends. The rear portion of closed matrix 59 is similar to the front portion of closed matrix 59 seen in FIG. 5, and includes a plurality of cavities 65 formed in bottom surface 63 and defined by closed matrix ribs 66. As can be seen by comparing FIGS. 5 and 7, the sizes and shapes of cavities 65 vary somewhat when moving from the front of closed matrix 59 to the rear of closed matrix 59. Cavities 65 and ribs 62 in midfoot and heel regions of closed matrix 59 are smaller and more closely packed than cavities 65 and ribs 62 in a forefoot region of closed matrix 59.

As indicated in FIG. 7, and as can generally be seen throughout FIGS. 4A-7, each of receptacles 55 includes a hub 85. Each hub 85 is positioned within an opening 84 that passes completely through base plate 53. Hubs 85 include central bores 86 and are attached to flanges 87. Each central bore 86 is internally threaded and configured to accept and secure an externally threaded stud of a track spike. Flanges 87 radiate outward from hubs 85 and provide additional surface area to help secure a receptacle 55 in a desired position.

Figure 8:
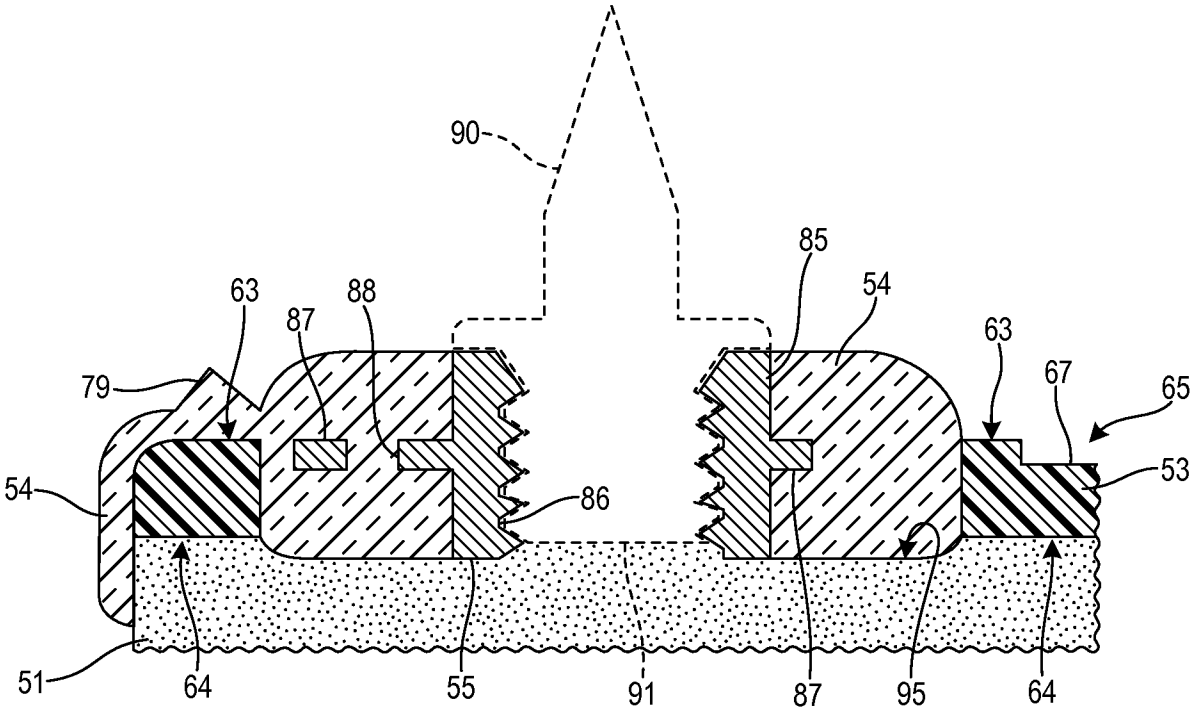
FIG. 8 is an enlarged area cross-sectional view taken from a location indicated in FIG. 5.

FIG. 8 is an enlarged area cross-sectional view taken from the location indicated in FIG. 5, and with the sectioning plane extending partially into midsole 51. FIG. 8 shows additional details of the manner in which receptacles 55 are secured in sole structure 12. The structure shown in FIG. 8 is typical of the manner in which other receptacles 55 are secured in sole structure 12. Each of receptacles 55 is embedded in the material of rim 54. As seen in FIG. 8, the second material of rim 54 is bonded to bottom surface 63 of base plate 53. The second material of rim 54 also fills openings 84 in base plate 53 and is bonded to the walls of openings 84. The second material of rim 54 also extends slightly above a top surface 64 of base plate 53.

Each receptacle 55 is embedded in the portion of the rim 54 second material that fills an opening 84, as well as in the portions of the rim 54 second material above and below that opening. The rim 54 second material contacts and bonds to all of the outer surfaces of each hub 85, as well as to the outer surfaces of the flanges 87 extending radially outward from each hub 85. In some embodiments, flanges 87 may include slots 88 that are filled by the second material of rim 54.

FIG. 8 further shows, in broken line silhouette, a track spike 90 secured in receptacle 85. As indicated above, bores 86 of receptacles 55 include internal screw threads. Those internal screw threads correspond to external screw threads on a stud 91 of a track spike 90. This allows a track spike to be screwed into and secured in a receptacle 55, and further allows non-destructive removal of the track spike by unscrewing. In other embodiments, a receptacle might be configured in another manner to secure a traction element and to allow subsequent non-destructive removal of that traction element. As one example, slots formed in a bore could cooperate with pins extending radially from a traction element stud.

Figure 9:
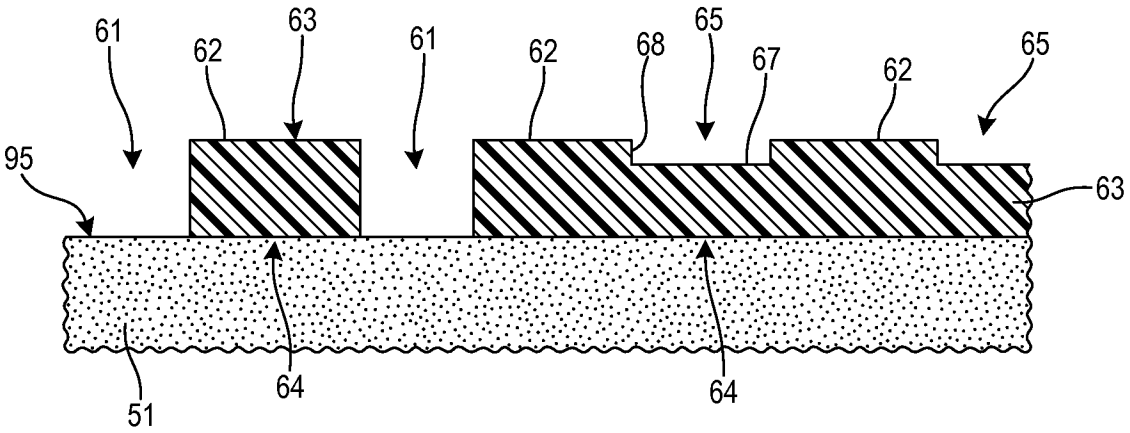
FIG. 9 is an enlarged area cross-sectional view taken from another location indicated in FIG. 5.

FIG. 9 is an enlarged area cross-sectional view taken from another location indicted in FIG. 5, and with the sectioning plane extending partially into midsole 51. FIG. 9 shows additional details of a portion of base plate 53 that includes two apertures 61 and two cavities 65. As seen in FIG. 9, a bottom surface 95 of midsole 51 is bonded directly to a top surface 64 of base plate 53.

In some embodiments, sole structure 12 may be formed using a dual injection process in which the material having the lower melting point is injected first. After that material cools, the second material is injected. In embodiments where the material of rim 54 has a lower melting temperature than the material used to form base plate plate 53, receptacles 55 may be placed in a mold and the material of rim 54 injected. Subsequently, the material of base plate 53 may be injected.

Features of shoe 10 offer various advantages. Medial restraint straps 31-33 provide additional support and help prevent movement of a wearer foot relative to sole structure 12 during the lift-off portion of a high jump. Because sole structure 12 includes elements to help prevent slipping of sole structure relative to the ground (e.g., track spikes 91, fixed secondary traction elements 78 and 79), this helps to prevent loss of energy that might be used to increase jump height. The matrix structures of base plate 53 help to reduce weight while maintaining overall thickness of base plate 53. Because stiffness of member in a bending plane varies with the cube (third power) of thickness in that bending plane, the stiffness of base plate 53 is greater than it might be if the same amount of material were used to form a thinner plate without apertures 61 and cavities 65. The sizes of aperture 61 and/or cavities 65 may be increased, and/or the spacing between apertures 61 and/or between cavities 65 varied, in regions where increased stiffness is desired. In the embodiment of shoe 10, for example, and as seen in FIG. 4A, apertures 61 and cavities 65 are smaller in midfoot and heel regions where increased stiffness is desired.

Other embodiments include numerous additional variations on the components and combinations described above. Without limitation, such variations may include one or more of the following:

A base plate may include more than one material. Similarly, a rim could include more than one material.

The sizes of apertures in an open matrix, and/or the size and/or depth of cavities in a closed matrix, could be varied.

A closed matrix need not extend continuously between open matrices. For example, a portion of a closed matrix could be replaced with a product logo.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and their practical application to enable one skilled in the art to utilize the present invention in various embodiments and with various modifications as are suited to the particular use contemplated. Any and all combinations, sub-combinations and permutations of features from herein-described embodiments are the within the scope of the invention. In the claims, a reference to a potential or intended wearer or a user of a component does not require actual wearing or using of the component or the presence of the wearer or user as part of the claimed invention.

The invention claimed is:

1. An article of footwear comprising:

an upper; and a sole structure coupled to the upper and including a base plate, a rim, and a plurality of receptacles, and wherein each of the receptacles is embedded in the rim and is configured to retain and permit non-destructive removal of a traction element, the base plate extends under substantially all of a footbed of the article, the rim is attached to and overlays a peripheral portion of a base plate bottom surface, the peripheral portion including medial forefoot, lateral forefoot, lateral midfoot, lateral heel, and medial heel sub-portions, the rim at least partially surrounds an exposed central forefoot region and an exposed central heel region of the base plate bottom surface, and the base plate includes a forefoot open matrix portion extending over at least a part of the central forefoot region and a heel open matrix portion extending over at least a part of the central heel region, each of the forefoot open matrix portion and the heel open matrix portion including a plurality of apertures defined by ribs, each of the apertures extending from the base plate bottom surface to a base plate top surface.

2. The article of footwear of claim 1, wherein the base plate is formed from a first material and the rim is formed from a second material different from the first material.

3. The sole structure of claim 2, wherein the second material is transparent.

4. The article of footwear of claim 1, further comprising a reinforcing strap located on a medial side of the upper.

5. The article of footwear of claim 4, wherein the reinforcing strap is a midfoot reinforcing strap secured in an arch region.

6. The article of footwear of claim 5, wherein the midfoot reinforcing strap is adjustably securable to a lateral/instep strap secured on a lateral side of the article.

7. The article of footwear of claim 5, further comprising a forefoot reinforcing strap positioned in a medial forefoot region of the upper.

8. The article of footwear of claim 4, wherein the reinforcing strap is a forefoot reinforcing strap positioned in a medial forefoot region of the upper.

9. The article of footwear of claim 1, wherein the sole structure includes a polymer foam midsole having a bottom surface bonded directly to the base plate top surface.

10. The article of footwear of claim 1, wherein each of the receptacles extends into a corresponding opening formed in the base plate.

11. The article of footwear of claim 10, wherein the base plate is formed from a first material and the rim is formed from a second material different from the first material, each of the openings is filled with the second material, and each of the receptacles is embedded in the second material filling the opening corresponding to that receptacle.

12. The article of footwear of claim 1, wherein the rim surrounds an entire peripheral edge of the base plate.

13. The article of footwear of claim 12, wherein the rim includes a projection extending into a central region of the base plate from the medial side, the projection approximately located at the rear of a forefoot region.

14. The article of footwear of claim 1, wherein a bottom surface of the rim includes fixed secondary projections formed therein.

15. The article of footwear of claim 1, wherein fixed secondary projections are formed in a bottom surface of the forefoot open matrix portion.

16. The article of footwear of claim 15, wherein the fixed secondary projections are located at junctions of the ribs.

17. The article of footwear of claim 15, wherein a bottom surface of the rim includes fixed secondary projections formed therein.

18. The article of footwear of claim 1, wherein the base plate includes a closed matrix portion extending over at least a portion of a central midfoot region, the closed matrix portion including a plurality of cavities formed in the base plate bottom surface and defined by ribs, each of the cavities having a floor formed by a first material and side walls formed by a subset of the ribs defining that cavity.

19. The article of footwear of claim 18, further comprising a midfoot reinforcing strap located on a medial side of the upper and secured in an arch region and a forefoot reinforcing strap positioned in a medial forefoot region of the upper.

20. The article of footwear of claim 19, wherein a bottom surface of the rim includes fixed secondary projections formed therein, and wherein fixed secondary projections are formed in a bottom surface of the forefoot open matrix portion.

* * * * *